US007404689B1

(12) United States Patent
Poling

(10) Patent No.: US 7,404,689 B1
(45) Date of Patent: Jul. 29, 2008

(54) DRAINAGE BOARD SYSTEM

(76) Inventor: Steven T. Poling, 5746 Stag Thicket La., Palm Harbor, FL (US) 34685

( * ) Notice: Subject to any disclaimer, the term of this patent is extended or adjusted under 35 U.S.C. 154(b) by 430 days.

(21) Appl. No.: 11/167,372

(22) Filed: Jun. 27, 2005

(51) Int. Cl.
*E01C 9/00* (2006.01)

(52) U.S. Cl. ..... 404/31; 404/36; 404/35

(58) Field of Classification Search ..... 404/36, 404/34, 35, 31; 52/302.1, 480, 403.1, 302.3, 52/746.1, 169.5, 177; 405/36
See application file for complete search history.

(56) References Cited

U.S. PATENT DOCUMENTS

| | | | | | |
|---|---|---|---|---|---|
| 3,687,021 | A | | 8/1972 | Hensley | |
| 3,802,144 | A | * | 4/1974 | Spica | 52/591.2 |
| 4,478,901 | A | * | 10/1984 | Dickens et al. | 428/120 |
| 5,259,163 | A | * | 11/1993 | Pacione | 52/511 |
| D358,053 | S | * | 5/1995 | Austin | D6/585 |
| 5,666,772 | A | | 9/1997 | Betty | |
| 6,526,704 | B1 | * | 3/2003 | Berard et al. | 52/177 |
| 6,599,599 | B1 | * | 7/2003 | Buckwater et al. | 428/40.1 |
| 6,737,150 | B2 | * | 5/2004 | Zahler et al. | 428/156 |
| 6,802,167 | B2 | * | 10/2004 | Pacione | 52/506.05 |
| 7,043,792 | B2 | * | 5/2006 | Kessler | 15/215 |
| 7,185,473 | B2 | * | 3/2007 | Pacione | 52/747.11 |
| 2002/0139074 | A1 | * | 10/2002 | Smith | 52/302.1 |
| 2003/0154676 | A1 | * | 8/2003 | Schwartz | 52/391 |
| 2005/0252109 | A1 | * | 11/2005 | Fuccella et al. | 52/177 |

* cited by examiner

*Primary Examiner*—Thomas B Will
*Assistant Examiner*—Alina Schiller
(74) *Attorney, Agent, or Firm*—Edward P. Dutkiewicz

(57) ABSTRACT

A coupling assembly is attached to the upper surface of a board having upper and lower surfaces. The coupling assembly is extendable upwardly for coupling to a covering surface. A plurality of projections on the lower surface of the board are extendable downwardly for contacting a floor for support. A plurality of apertures extends through the board for functioning with the projections for ventilation and moisture abatement.

1 Claim, 3 Drawing Sheets

FIG 1
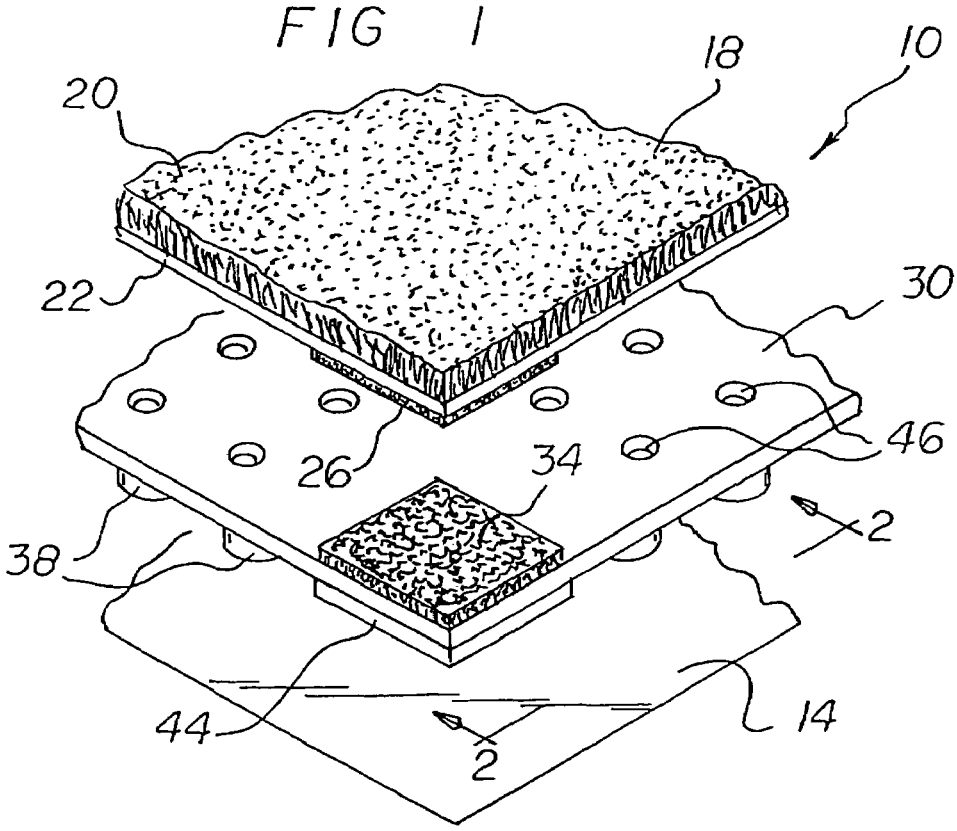
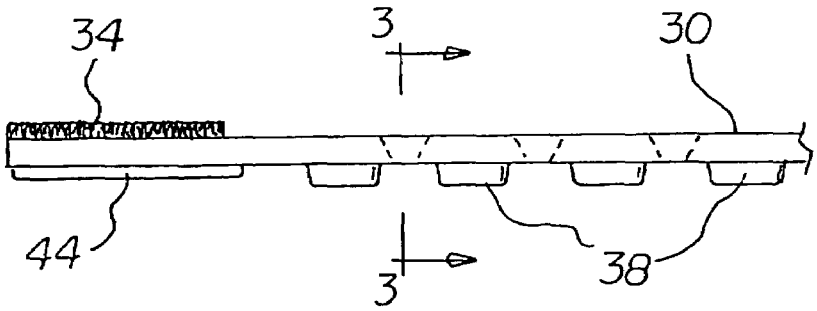
FIG 2

FIG 3
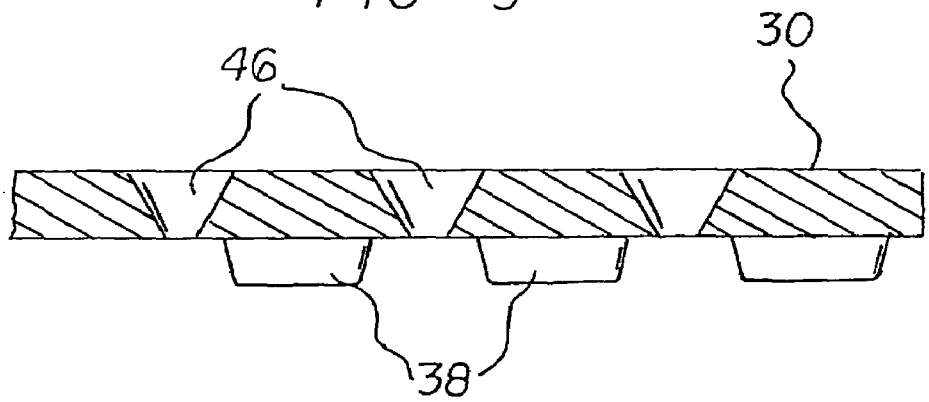
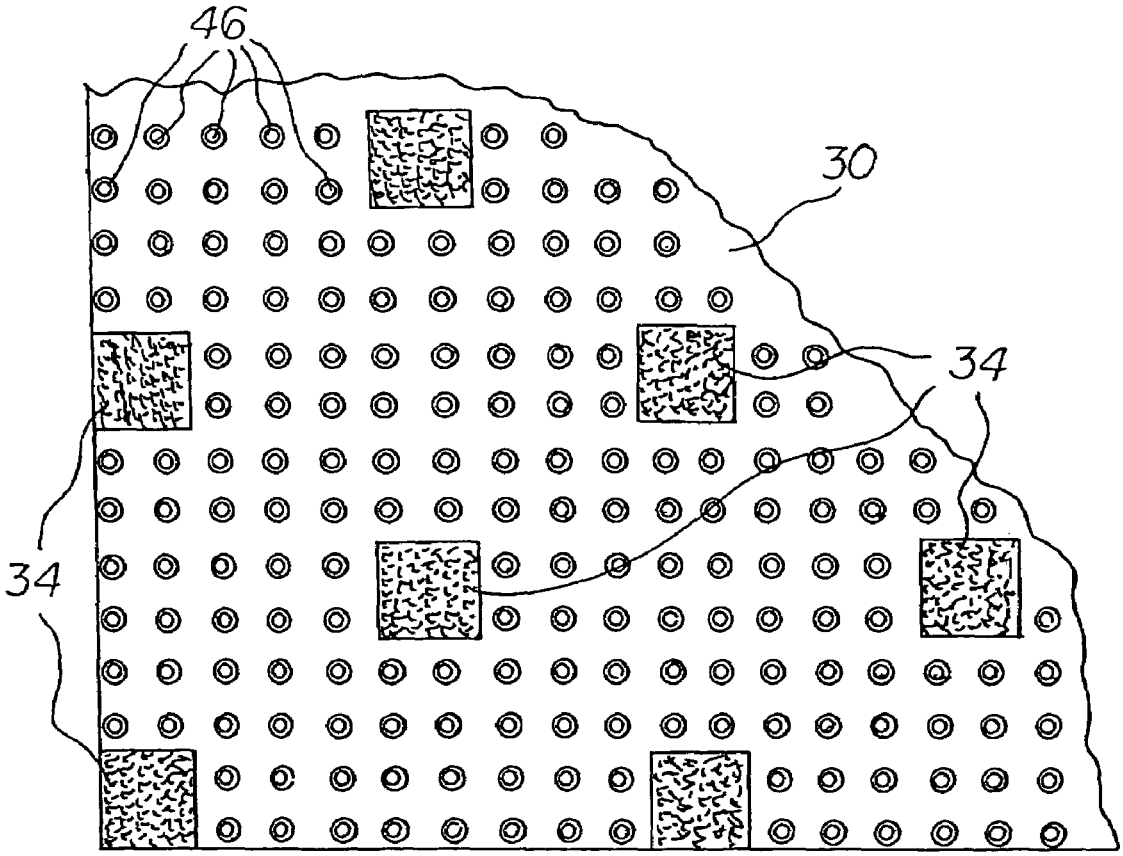
FIG 4

FIG 5
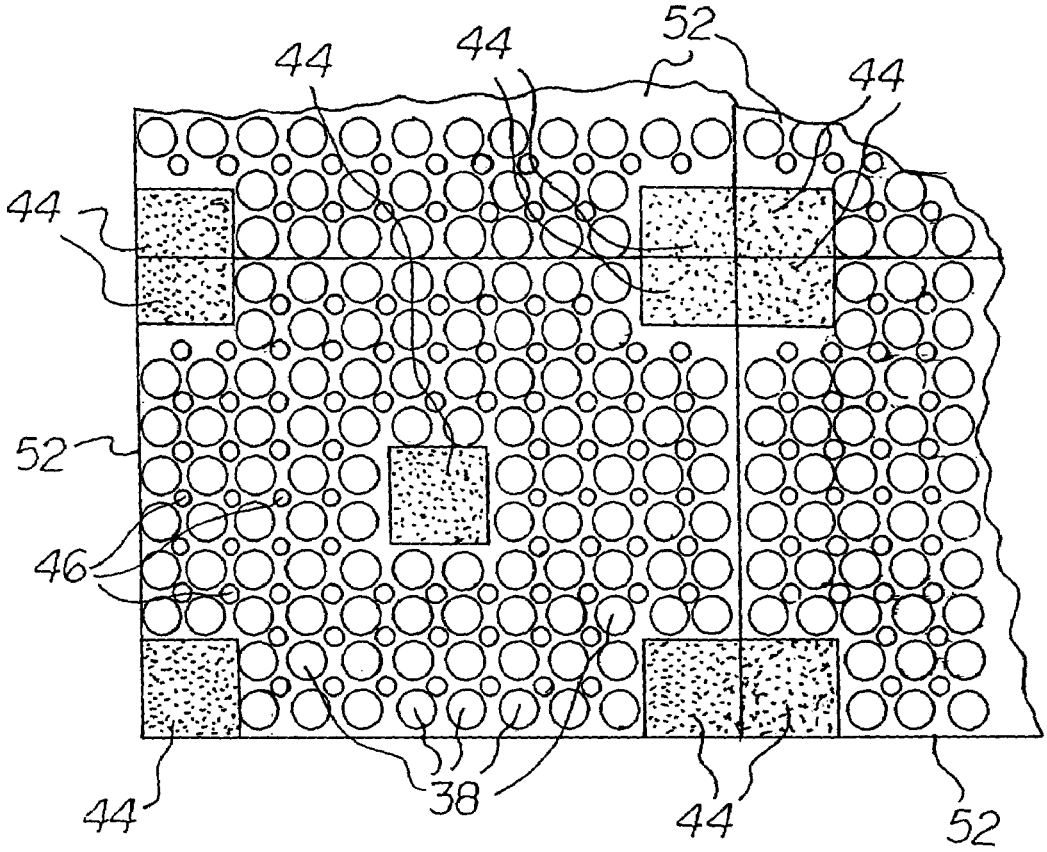
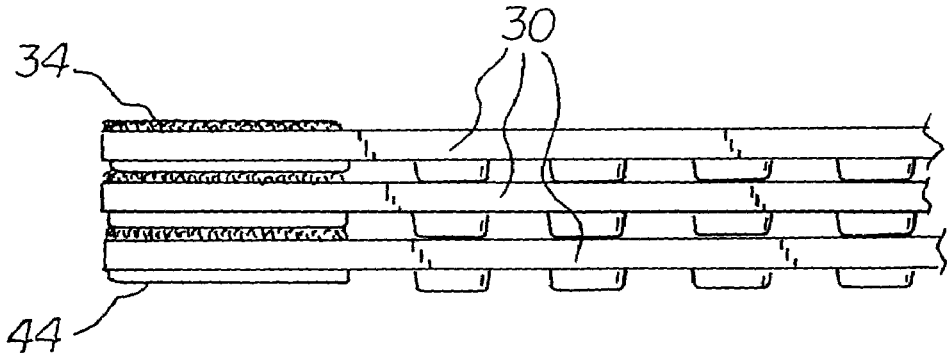
FIG 6

DRAINAGE BOARD SYSTEM

BACKGROUND OF THE INVENTION

1. Field of the Invention

The present invention relates to a drainage board system and more particularly pertains to extending the life of outdoor carpet while enhancing its appearance.

2. Description of the Prior Art

The use of drainage systems of known designs and configurations is known in the prior art. More specifically, drainage systems of known designs and configurations previously devised and utilized for the purpose of draining floors through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,687,021 issued Aug. 29, 1972 to Hensley relates to Vertically Draining Flat Structures. U.S. Pat. No. 5,666,772 issued Sep. 16, 1997 to Betty relates to a Patio/Floor Assembly. U.S. Pat. No. 6,802,167 issued Oct. 12, 2004 to Pacione relates to Anchor Sheet Framework and Subflooring. U.S. Pat. No. 5,259,163 issue Nov. 9, 1993 to Pacione relates to an Anchor Board System. Lastly, U.S. Pat. No. 6,599,599 issued Jul. 29, 2003 to Buckwater relates to an Underlayment Composite and Associated Flooring Installation System.

While these devices fulfill their respective, particular objectives and requirements, the aforementioned patents do not describe a drainage board system that extends the life of outdoor carpet while enhancing its appearance.

In this respect, the drainage board system according to the present invention substantially departs from the conventional concepts and designs of the prior art, and in doing so provides an apparatus primarily developed for the purpose of extending the life of outdoor carpet while enhancing its appearance.

Therefore, it can be appreciated that there exists a continuing need for a new and improved drainage board system which can be used for extending the life of outdoor carpet while enhancing its appearance. In this regard, the present invention substantially fulfills this need.

SUMMARY OF THE INVENTION

In view of the foregoing disadvantages inherent in the known types of drainage systems of known designs and configurations now present in the prior art, the present invention provides an improved drainage board system. As such, the general purpose of the present invention, which will be described subsequently in greater detail, is to provide a new and improved drainage board system and method which has all the advantages of the prior art and none of the disadvantages.

To attain this, the present invention essentially comprises a drainage board system. First provided is an exterior planar floor surface. The surface is fabricated of concrete. The surface is further adapted to receive carpet.

A carpet is provided. The carpet is formed in a generally rectangular configuration. The carpet has edges. The carpet is fabricated of flexible fibrous material. The carpet has an upper surface and a lower surface. The upper surface includes a decorative pattern. The lower surface is adapted to rest flat and in parallel relationship with respect to the floor surface.

Provided next is a plurality of upper patches. The upper patches each are in a square configuration. The side measurement of each patch is between 1.0 and 3.0 inches and preferably 2.0 inches. Each patch has downwardly extending hooks and loops of a hook and loop releasable coupling assembly. The patches are attached to the lower surface of the carpet in a symmetric pattern along adjacent edges and spaced from the edges.

A rectangular board is provided. The board is fabricated of a substantially rigid, moisture resistant material. The material is preferably plastic, more preferably polyurea or some equivalent polymer. The board has an upper surface and a lower surface. A thickness is provided between the upper and lower surfaces. The thickness is between 0.25 inches and 1.00 inches and preferably about 0.50 inches.

A plurality of lower patches is provided next. Each of the lower patches is in a square configuration. The side of each lower patch is between 1.0 and 3.0 inches. Each patch has upwardly extending hooks and loops of a hook and loop releasable coupling assembly. The patches are attached to the upper surface of the board in a symmetric pattern along adjacent edges and spaced from the edges. The symmetric pattern on the patches on the board corresponding to the symmetric pattern of patches on the carpet are adapted for separable coupling therebetween.

A plurality of cylindrical projections is provided. The cylindrical projections are provided on the lower surface of the board remote from the patches. The projections extend downwardly and contact the floor. In this manner ventilation and support are provided and moisture is abated. The projections are arranged in linearly aligned rows and columns. The projections are spaced apart between 0.5 inches and 2.0 inches and preferably 1.0 inches. The average diameter is between 0.25 inches and 1.00 inches and preferably about 0.50 inches. The thickness is essentially equal to the thickness of the board, plus or minus 50 percent.

Further provided is a plurality of rectangular spacers. The spacers are provided on the lower surface of the board remote from the patches and projections. The spacers extend downwardly. The projections are arranged in linearly aligned rows and columns corresponding to the patches on the board. Each spacer is in a square configuration between 1.0 and 3.0 inches and preferably 2.0 inches. The thickness is essentially equal to half of the thickness of the patches, plus or minus 25 percent. In this manner stacking for storage and transportation is facilitated.

Provided last is a plurality of apertures. The apertures extend through the board in linearly aligned rows and columns. The apertures are spaced apart between 0.5 inches and 2.0 inches and preferably 1.0 inches. The apertures are geometrically shaped. In one embodiment the apertures are cylindrical with a diameter of between about 0.25 and 0.50 inches. In another embodiment, the apertures are cone-shaped. The apertures have a larger diameter at the upper surface. The apertures have a smaller diameter at the lower surface. The average diameter is between 0.25 inches and 0.50 inches for functioning with the projections for ventilation and moisture abatement.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drainage board system which has all of the advantages of the prior art drainage systems of known designs and configurations and none of the disadvantages.

It is another object of the present invention to provide a new and improved drainage board system which may be easily and efficiently manufactured and marketed.

It is further object of the present invention to provide a new and improved drainage board system which is of durable and reliable constructions.

An even further object of the present invention is to provide a new and improved drainage board system which is susceptible of a low cost of manufacture with regard to both materials and labor, and which accordingly is then susceptible of low prices of sale to the consuming public, thereby making such drainage board system economically available to the buying public.

Even still another object of the present invention is to provide a drainage board system for extending the life of outdoor carpet while enhancing its appearance.

Lastly, it is an object of the present invention to provide a new and improved drainage board system. A board has an upper surface and a lower surface. A coupling assembly is attached to the upper surface of a board. The coupling assemblies extend upwardly for coupling to a surface covering. A plurality of projections is provided on the lower surface of the board. The projections extend downwardly and contact the floor. In this manner ventilation and support are provided and moisture is abated. A plurality of apertures extends through the board for functioning with the projections for ventilation and moisture abatement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an exploded perspective illustration of a drainage board system constructed in accordance with the principles of the present invention.

FIG. 2 is a side elevational view of the board taken along line 2-2 of FIG. 1.

FIG. 3 is a cross sectional view of the board taken along line 3-3 of FIG. 2.

FIG. 4 is a plan view of the board illustrated in the prior Figures.

FIG. 5 is a bottom view of a plurality of boards illustrated in the prior Figures but with the edges adjacent boards abutting.

FIG. 6 is a side elevational view of a plurality of boards stacked for storage and/or shipping.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved drainage board system embodying the principles and concepts of the present invention and generally designated by the reference numeral 10 will be described.

The present invention, the drainage board system 10 is comprised of a plurality of components. Such components in their broadest context include a board, a plurality of coupling assemblies, a plurality of projections, and a plurality of apertures. Such components are individually configured and correlated with respect to each other so as to attain the desired objective.

First provided is a support surface, preferably an exterior planar floor surface 14. The surface is fabricated of concrete. The surface is further adapted to receive carpet.

A surface covering, preferably a carpet 18, is next provided. The carpet is formed in a generally rectangular configuration. The carpet has edges. The carpet is fabricated of flexible fibrous material. The carpet has an upper surface 20 and a lower surface 22. The upper surface includes a decorative pattern. The lower surface is adapted to rest flat and in parallel relationship with respect to the floor surface.

Provided next is a plurality of upper patches 26. The upper patches each are in a square configuration. The side measurement of each patch is between 1.0 and 3.0 inches and preferably 2.0 inches. Each patch has downwardly extending hooks and loops of a hook and loop releasable coupling assembly. The patches are attached to the lower surface of the carpet in a symmetric pattern along adjacent edges and spaced from the edges.

A rectangular board 30 is provided. The board is fabricated of a substantially rigid, moisture resistant material. The material is preferably plastic, more preferably polyurea or some equivalent polymer. The board has an upper surface and a lower surface. A thickness is provided between the upper and lower surfaces. The thickness is between 0.25 inches and 1.00 inches and preferably about 0.50 inches.

A plurality of lower patches 34 is provided next. Each of the lower patches is in a square configuration. The side of each lower patch is between 1.0 and 3.0 inches. Each patch has upwardly extending hooks and loops of a hook and loop releasable coupling assembly. The patches are attached to the upper surface of the board in a symmetric pattern along adjacent edges and spaced from the edges. The symmetric pattern on the patches on the board corresponding to the symmetric pattern of patches on the carpet are adapted for separable coupling therebetween.

A plurality of cylindrical pedestals or projections 38 is provided. The cylindrical projections are provided on the lower surface of the board remote from the patches. The projections extend downwardly and contact the floor. In this manner ventilation and support are provided and moisture is abated. The projections are arranged in linearly aligned rows and columns. The projections are spaced apart between 0.5 inches and 2.0 inches and preferably 1.0 inches. The average diameter is between 0.25 inches and 1.00 inches and preferably about 0.50 inches. The thickness is essentially equal to the thickness of the board, plus or minus 50 percent.

Further provided is a plurality of rectangular spacers 44. The spacers are provided on the lower surface of the board remote from the patches and projections. The spacers extend downwardly. The projections are arranged in linearly aligned rows and columns corresponding to the patches on the board. Each spacer is in a square configuration between 1.0 and 3.0 inches and preferably 2.0 inches. The thickness is essentially equal to half of the thickness of the patches, plus or minus 25 percent. In this manner stacking for storage and transportation is facilitated.

Provided last is a plurality of apertures 46. The apertures extend through the board in linearly aligned rows and columns. The apertures are spaced apart between 0.5 inches and 2.0 inches and preferably 1.0 inches. The apertures are geometrically shaped. In one embodiment, the apertures are cylindrical with a diameter of between about 0.25 inches and 0.50 inches. In another embodiment, the apertures are cone-shaped. The apertures have a larger diameter at the upper surface. The apertures have a smaller diameter at the lower surface. The average diameter is between 0.25 inches and 0.50 inches for functioning with the projections for ventilation and moisture abatement.

A plurality of contiguous boards 52 are illustrated in FIG. 5. The spacers 44 are located at the center and corners of the contiguous boards. In this manner plural boards and spacers are positioned in contiguous relationships during operation and use.

Outdoor carpet is used as a floor covering for exterior balconies, walkways, sundecks, plaza decks, entrance ways, etc. Carpet is attractive, easy to clean and helps to deaden sound. In exterior applications, water saturates the carpet and it deteriorates rather quickly because it remains wet for long periods of time. Wet carpet on the outside causes water and dirt to be tracked inside, often to flooring that is slippery when wet.

The biggest problem occurs when carpet is adhered with adhesive, carpet glue, directly to reinforced concrete that is exposed to marine environments. Chlorides, salt, from the gulf and ocean are carried by wind and rain and are deposited onto the carpet. Over time, high concentrations of chlorides build up in the carpet and are carried by water through the carpet glue into the concrete. Carpet and carpet glue on the concrete surface cause the concrete to stay moist allowing the chlorides to migrate deeper and quicker. Moisture and chlorides in concrete provide the perfect environment for the reinforcing steel in the concrete to corrode, rust. Eventually, this rusting causes cracking and spalling of concrete that is hidden because of the carpet and glue. This leads to potential structural problems and expensive repairs. After the repairs to the building are eventually made, the future use of outdoor carpet is often prohibited.

The extent of the corrosion problem is magnified and accelerated because of the carpet backing and the carpet glue placed directly onto the concrete. The backing and glue readily allow moisture to get through to the concrete but, after the concrete gets wet, they hold the moisture in the concrete and keep it from drying. This invention can be used to greatly reduce the corrosion problem and will allow carpet to be used after repairs are made. It is a pre-formed material used in place of the rubber backing on indoor/outdoor carpeting with secondary backing glue. It is perforated to allow for drainage and is on pedestals to allow air to move under it to assist in drying. It will be adhered to the structure at several points. On the topside of the part at these points will be hook and loop portions of a hoop and loop fastening system. The carpet backing will also have a hook and loop portion of the hook and loop fastening system and can be adhered to the part without adhesive or glue.

The advantages of the system of the present invention compared to adhering rubber-backed carpeting to the concrete surface with adhesive are as follows:

a) Less than 50 percent of the surface area normally adhered to the substrate will be in contact with the substrate.

b) There will be 90 percent less surface area adhered to the substrate. The concrete will retain its vapor permeability to allow moisture to leave through its surface.

c) Evaporation of water from the concrete is not prevented. The concrete remains naturally breathable so there will be less corrosion of the steel.

d) Waterproofing systems will not be kept wet so they will not deteriorate as quickly.

e) Environmentally friendly because no carpet glue or solvents are used.

f) May be injection molded, sprayed or formed and poured in modular, extremely durable squares.

g) Perforation allows for drainage.

h) Elevation, well supported on pedestals, allows carpet and substrate to dry more quickly and air to circulate beneath.

i) Possible injection Molded Hook (IMH) technology for manufacturing may allow loop cloth or loop carpet attachment in large sections after drainage board is in place.

j) Carpet and drainage board can be removed easily which facilitates cleaning of carpet and substrate as well as periodic inspection, maintenance and repair of waterproofing.

k) Flexibility allowing following contours of an uneven substrate.

l) Load-bearing and impact resistance protects waterproofing membranes.

m) Portions can be removed and replaced without the need for replacing the entire surface area.

n) Since the carpet is drier more often, less water and dirt will be tracked inside resulting in a cleaner and safer environment.

o) Life of the carpet is extended.

p) Damage to waterproofing membranes during installation and removal of carpet is eliminated. Re-waterproofing is less expensive.

q) The system of the present invention is more compatible over waterproofing systems than using adhesives to glue the carpet to the entire surface.

The primary use of the invention is as a drainage board with removable/reusable attachment on reinforced concrete balconies and walkways. Upon this is placed carpet utilizing removable/reusable attachment. However, other applications can be envisioned, as for example, decorative floor covering or even decorative surface covering and may include horizontal and vertical applications. Tile or other decorative finishes might be used both in horizontal and vertical applications.

Various methods for fastening the drainage board system to the substrate, not limited to concrete, and the decorative surface covering, again not limited to carpet or horizontal applications, to the drainage board system can be envisioned or possibly required. These may include the hook and loop method, glue or various other adhesives, double-sided tape, mechanical fasteners, self-adhering finishes, etc. As example, a self-adhering linoleum tile or sheet good of some type might be applied to the drainage board.

When used in its primary use, one of the biggest advantages of the invention that also extends the life and enhances the appearance of the carpet is that the drainage board and carpet can easily be removed for extended periods of time. For example, a seasonal resident can remove the board and carpet before leaving for extended periods of time. The materials can be stored inside until the resident's return and then be reinstalled.

Concrete is waterproofed and carpet is sometimes adhered directly to the waterproofing. Using this drainage board system can both extend the life of the waterproofing and greatly reduce the cost when the waterproofing eventually needs to be re-done.

Preferably, the drainage board system is fabricated by spraying material into an open form. This means:

a) no injection molding and no hooks molded into the part;

b) fabricated from polyurea or some other polymer;

c) using hook and loop tape, or other attachment;

d) holes straight through; and e) size of the board still to be determined including sizes significantly larger and smaller than the sizes disclosed herein. Alternately, injection molding is a fabrication technique.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drainage board system for extending the life of outdoor carpet while enhancing its appearance comprising, in combination:

an exterior planar floor surface fabricated of concrete and adapted to receive carpet thereon;

a carpet formed in a generally rectangular configuration with edges and fabricated of flexible fibrous material with an upper surface and a lower surface, the upper surface including a decorative pattern, the lower surface adapted to rest flat and in parallel relationship with respect to the floor surface;

a plurality of upper patches, the upper patches each being in a square configuration between 1.0 and 3.0 inches on a side with downwardly extending loops of a hook and loop releasable coupling assembly, the patches being attached to the lower surface of the carpet in a symmetric pattern along adjacent edges and spaced from the edges;

a rectangular board fabricated of a substantially rigid, moisture resistant polyurea, the board having an upper surface and a lower surface with a thickness of between 0.25 inches and 1.00 inches;

a plurality of lower patches, the lower patches each being in a square configuration between 1.0 and 3.0 inches on a side with upwardly extending hooks of a hook and loop releasable coupling assembly, the patches being attached to the upper surface of the board in a symmetric pattern along adjacent edges and spaced from the edges, the symmetric pattern on the patches on the board corresponding to the symmetric pattern of patches on the carpet for the separable coupling therebetween;

a plurality of cylindrical projections on the lower surface of the board remote from the patches and extending downwardly for contacting the floor for ventilation and moisture abatement and support, the projections being arranged in linearly aligned rows and columns spaced apart between 0.5 inches and 2.0 inches with an average diameter of between 0.25 inches and 1.00 inches and a thickness essentially equal to the thickness of the board, plus or minus 50 percent;

a plurality of rectangular spacers on the lower surface of the board remote from the patches and projections and extending downwardly, the projections being arranged in linearly aligned rows and columns corresponding to the patches on the board, each spacer being in a square configuration between 1.0 and 3.0 inches with a thickness essentially equal to half of the thickness of the patches, plus or minus 25 percent, to facilitate stacking for storage and transportation; and a plurality of apertures extending through the board in linearly aligned rows and columns spaced apart between 0.5 inches and 2.0 inches the apertures in a geometric shape, including conical and cylindrical, with a larger diameter at the upper surface and a smaller diameter at the lower surface and with an average diameter between 0.25 inches and 0.50 inches for functioning with the projections for ventilation and moisture abatement.

* * * * *